US010688812B2

(12) United States Patent
Perez Gellida et al.

(10) Patent No.: US 10,688,812 B2
(45) Date of Patent: Jun. 23, 2020

(54) CURING APPARATUS, IMAGE FORMING APPARATUS, AND ARTICLES OF MANUFACTURE

(71) Applicant: HEWLETT-PACKARD DEVELOPMENT COMPANY, L.P., Spring, TX (US)

(72) Inventors: Francisco Javier Perez Gellida, Sant Cugat del Valles (ES); Luis Fernando Martinez Nieto, Sant Cugat del Valles (ES); Francisco Javier Rodriguez Escanuela, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/369,453

(22) Filed: Mar. 29, 2019

(65) Prior Publication Data

US 2019/0224991 A1 Jul. 25, 2019

Related U.S. Application Data

(60) Continuation of application No. 15/728,774, filed on Oct. 10, 2017, now Pat. No. 10,286,687, which is a division of application No. 14/130,452, filed as application No. PCT/US2011/042831 on Jul. 1, 2011, now Pat. No. 9,855,769.

(51) Int. Cl.

| | |
|---|---|
| ***B41J 11/00*** | (2006.01) |
| ***B41J 29/38*** | (2006.01) |
| ***F26B 15/00*** | (2006.01) |
| ***F26B 21/00*** | (2006.01) |
| ***F26B 23/04*** | (2006.01) |

(52) U.S. Cl.

CPC ..... *B41J 11/002* (2013.01); *B41J 29/38* (2013.01); *F26B 15/00* (2013.01); *F26B 21/00* (2013.01); *F26B 23/04* (2013.01)

(58) Field of Classification Search

None

See application file for complete search history.

(56) References Cited

U.S. PATENT DOCUMENTS

| | | | |
|---|---|---|---|
| 4,414,913 | A | 11/1983 | Sarda |
| 5,847,722 | A | 12/1998 | Hackleman |
| 6,152,030 | A | 11/2000 | Fuqua |
| 6,447,112 | B1 | 9/2002 | Hu |
| 6,561,640 | B1 | 5/2003 | Young |
| 6,807,906 | B1 | 10/2004 | DeMoore et al. |
| 6,857,734 | B2 | 2/2005 | Yamamoto |
| 6,877,247 | B1 | 4/2005 | DeMoore |
| 6,877,853 | B2 | 4/2005 | Kiguchi et al. |

(Continued)

FOREIGN PATENT DOCUMENTS

| | | |
|---|---|---|
| CN | 101253247 | 8/2008 |
| CN | 101389482 | 3/2009 |

(Continued)

*Primary Examiner* — John Zimmermann

(74) *Attorney, Agent, or Firm* — Fabian VanCott

(57) ABSTRACT

Curing apparatus, image forming apparatus and articles of manufacture are disclosed. An example curing apparatus includes a curing unit to heat an area adjacent a substrate travel path, the curing unit having a width less than a width of the substrate travel path, and a controller to reciprocate the curing unit within the substrate width.

17 Claims, 9 Drawing Sheets

(56) References Cited

U.S. PATENT DOCUMENTS

| | | | | |
|---|---|---|---|---|
| 7,131,723 | B2 | 11/2006 | Hoshino | |
| 7,517,075 | B2 * | 4/2009 | Smith | B41J 11/002 346/25 |
| 7,600,867 | B2 | 10/2009 | Mills | |
| 8,177,350 | B2 * | 5/2012 | Mitsuzawa | B41J 11/002 347/102 |
| 8,979,257 | B2 | 3/2015 | Cofler | |
| 2001/0038408 | A1 * | 11/2001 | Codos | B41J 2/01 347/102 |
| 2001/0043338 | A1 * | 11/2001 | Williams | B41J 19/202 358/1.5 |
| 2003/0020795 | A1 | 1/2003 | Baer | |
| 2003/0164870 | A1 | 9/2003 | Yamamoto | |
| 2004/0048001 | A1 | 3/2004 | Kiguchi | |
| 2004/0145642 | A1 | 7/2004 | Hoshino | |
| 2004/0189773 | A1 | 9/2004 | Masumi | |
| 2005/0068396 | A1 | 3/2005 | Ferran | |
| 2005/0168555 | A1 * | 8/2005 | Niekawa | B41J 11/002 347/102 |
| 2006/0007290 | A1 * | 1/2006 | Oshima | B41J 3/543 347/102 |
| 2007/0058020 | A1 | 3/2007 | Wetjens et al. | |
| 2007/0109382 | A1 * | 5/2007 | Lafleche | B41J 11/0015 347/102 |
| 2007/0273739 | A1 | 11/2007 | Rodin | |
| 2008/0174648 | A1 | 7/2008 | Nakano | |
| 2008/0204535 | A1 | 8/2008 | Sakagami | |
| 2009/0004368 | A1 | 1/2009 | Hirahara et al. | |
| 2009/0027438 | A1 | 1/2009 | Tanaka | |
| 2009/0244157 | A1 | 10/2009 | Hishida | |
| 2009/0246403 | A1 | 10/2009 | Wetjens | |
| 2010/0154244 | A1 | 6/2010 | Kuta et al. | |
| 2010/0156976 | A1 | 6/2010 | Seo | |

FOREIGN PATENT DOCUMENTS

| | | | |
|---|---|---|---|
| CN | 201279972 | | 7/2009 |
| DE | 19835046 | | 4/1998 |
| EP | 1447223 | | 8/2004 |
| JP | H08142327 | | 6/1996 |
| JP | H10119279 | | 5/1998 |
| JP | 2004-050546 | | 2/2004 |
| JP | 2004-167793 | | 6/2004 |
| JP | 2004-299062 | | 10/2004 |
| JP | 2006-026970 | | 2/2006 |
| JP | 2006-159873 | | 6/2006 |
| JP | 2007-152671 | | 6/2007 |
| JP | 2008000986 | | 1/2008 |
| JP | 2008-062433 | | 3/2008 |
| JP | 2008-188983 | A | 8/2008 |
| JP | 2009184211 | | 8/2009 |
| JP | 2009208421 | | 9/2009 |
| JP | 2010089455 | | 4/2010 |
| JP | 2010125834 | | 6/2010 |
| JP | 2010167620 | | 8/2010 |
| JP | 2011110792 | | 6/2011 |
| KR | 10-2008-0114712 | A | 12/2008 |

* cited by examiner

CURING APPARATUS, IMAGE FORMING APPARATUS, AND ARTICLES OF MANUFACTURE

BACKGROUND

While some printing inks air dry or dry without the use of heat, some other types of printing inks may bleed or diffuse over the print substrate if they do not dry quickly and may reduce print quality. Thus, some of these inks are subjected to heat to speed the drying process to maintain print quality.

DETAILED DESCRIPTION

Figure 1:
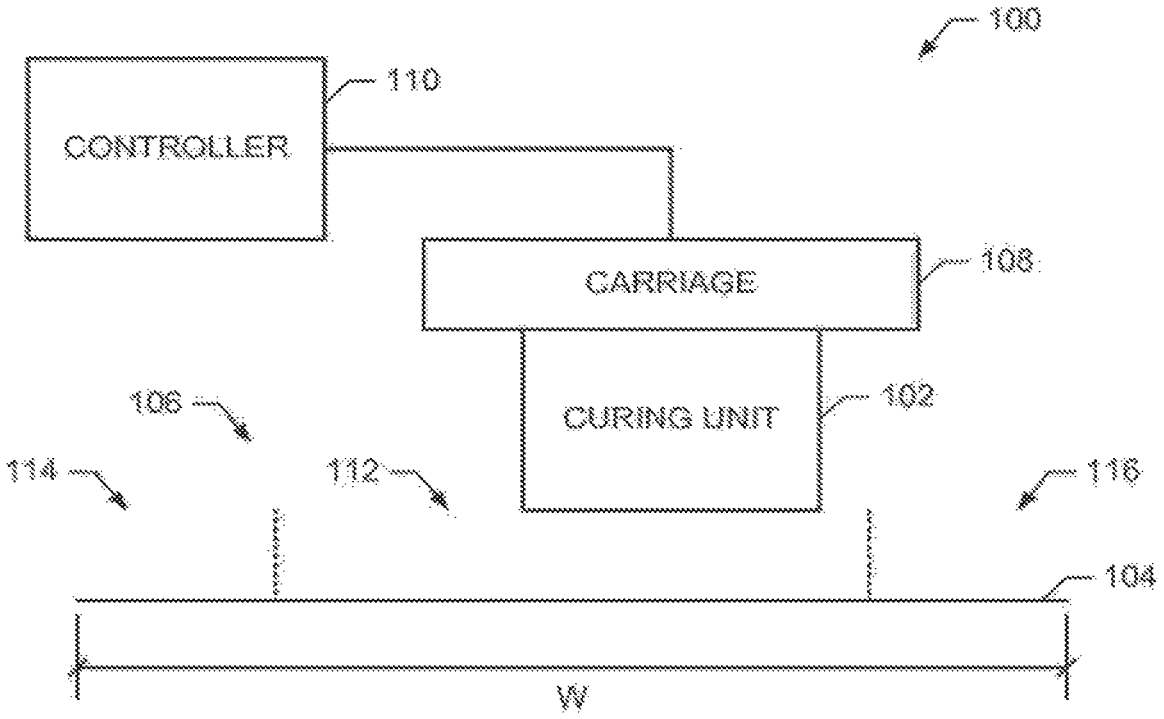
FIG. 1 illustrates an example apparatus including a curing unit, constructed in accordance with the teachings of this disclosure.

Example curing apparatus, image forming apparatus, and articles of manufacture disclosed herein may be used to cure inks or other marking agents applied to a print substrate. Example apparatus, image forming apparatus, and articles of manufacture disclosed herein may be used in wide-format printers (e.g., printers that support printing on substrates having an upper width limit of at least 1 meter (m)) and/or in other types of printers.

Known printers that include curing mechanisms extend and/or scan across an entire width of a print substrate path, which wastes energy. For instance, some known printers have an ultraviolet (UV) lamp attached to the side of a scanning print head. As the print head applies ink to the print substrate, the UV lamp immediately follows the print head to cure the ink. However, this known method causes the curing lamp to extend beyond the width of the print substrate, thereby wasting energy and causing the printer to be significantly wider than the width of the print substrate to accommodate the curing lamp. This known method is also not applicable to inks that use radiation-based curing because the size of radiation-based curing units are too large to use immediately adjacent the print head. Instead, using a radiation-based curing unit attached to the print head would use large amounts of energy, large amounts of space beyond the width of the print substrate, and/or involve a significant reduction in print speed to achieve effective curing.

Some known screen printers extend a curing unit along a track to a curing position when a substrate is placed in a curing position. This method significantly slows down the printing process and also uses additional space beyond the width of the substrate.

Example apparatus disclosed herein include a curing unit to cure an area longitudinally along a substrate travel path. In some such examples, a carriage physically supports the curing unit in a position for curing a substrate traveling in the substrate travel path. In some such examples, a controller causes the carriage to scan the curing unit over a first area based on a width of the substrate that is less than or equal to the width of the substrate travel path. In some examples, the curing unit has a width less than a width of the print substrate.

Some example apparatus disclosed herein may be brought from a cooled power-down state to a heated curing state in substantially less time than known curing apparatus. For example, some known curing apparatus are brought from a power-down state to a curing state in 5-8 minutes, while example apparatus disclosed herein are brought from a power-down state to a curing state in about 1 minute. In some such examples, the apparatus consumes about 1200 W to cure an identical print substrate width as compared to the known curing apparatus that consumes about 4300 W. This shorter heat up time and reduced power consumption is achieved in some disclosed examples at an equivalent or better printing speed with an equivalent or better curing performance than the known printer.

FIG. 1 illustrates an example curing apparatus 100 including a curing unit 102 constructed in accordance with the teachings of this disclosure. The example apparatus 100 may be used in combination with an image forming apparatus (e.g., a printer) to cure marking agents (e.g., ink) on a print substrate 104 during a print operation. The example curing unit 102 is supported adjacent a substrate travel path 106 by a carriage 108. In some examples, the substrate travel path 106 is defined by a platen that physically supports the print substrate 104. The substrate travel path 106 of the illustrated example has a width (W). The example print substrate 104 of FIG. 1 has a width (W) that is less than or equal to the width of the substrate travel path 106.

The example carriage 108 of FIG. 1 physically supports the curing unit 102 in a position for curing the example substrate 104 traveling in the substrate travel path 106. While the example carriage 108 is illustrated in FIG. 1 as located above the curing unit 102, the carriage 108 may have any other position and/or orientation relative to the print substrate 104 and/or the curing unit 102. In the illustrated example, a controller 110 causes the carriage 108 to move the curing unit 102 over the print substrate 104. In some examples, the controller 110 causes the carriage 108 to move the curing unit 102 at a first rate within a central region 112 of the print substrate 104 and move the curing unit 102 at a second rate (e.g., slower than the first rate) within either of two example edge regions 114, 116 of the substrate. The example controller 110 of FIG. 1 receives (e.g., from a server, a manual input, a register, etc.) or determines the width of the print substrate 104. Based on the width of the print substrate 104, the example controller 110 of FIG. 1 causes the carriage 108 to move the curing unit 102 over the width of the print substrate 104 and not beyond the print substrate 104. By avoiding moving the curing unit 102 beyond the width of the print substrate 104, the example apparatus 100 cures ink on the print substrate 104 while reducing or even preventing wasting electrical power.

Figure 2:
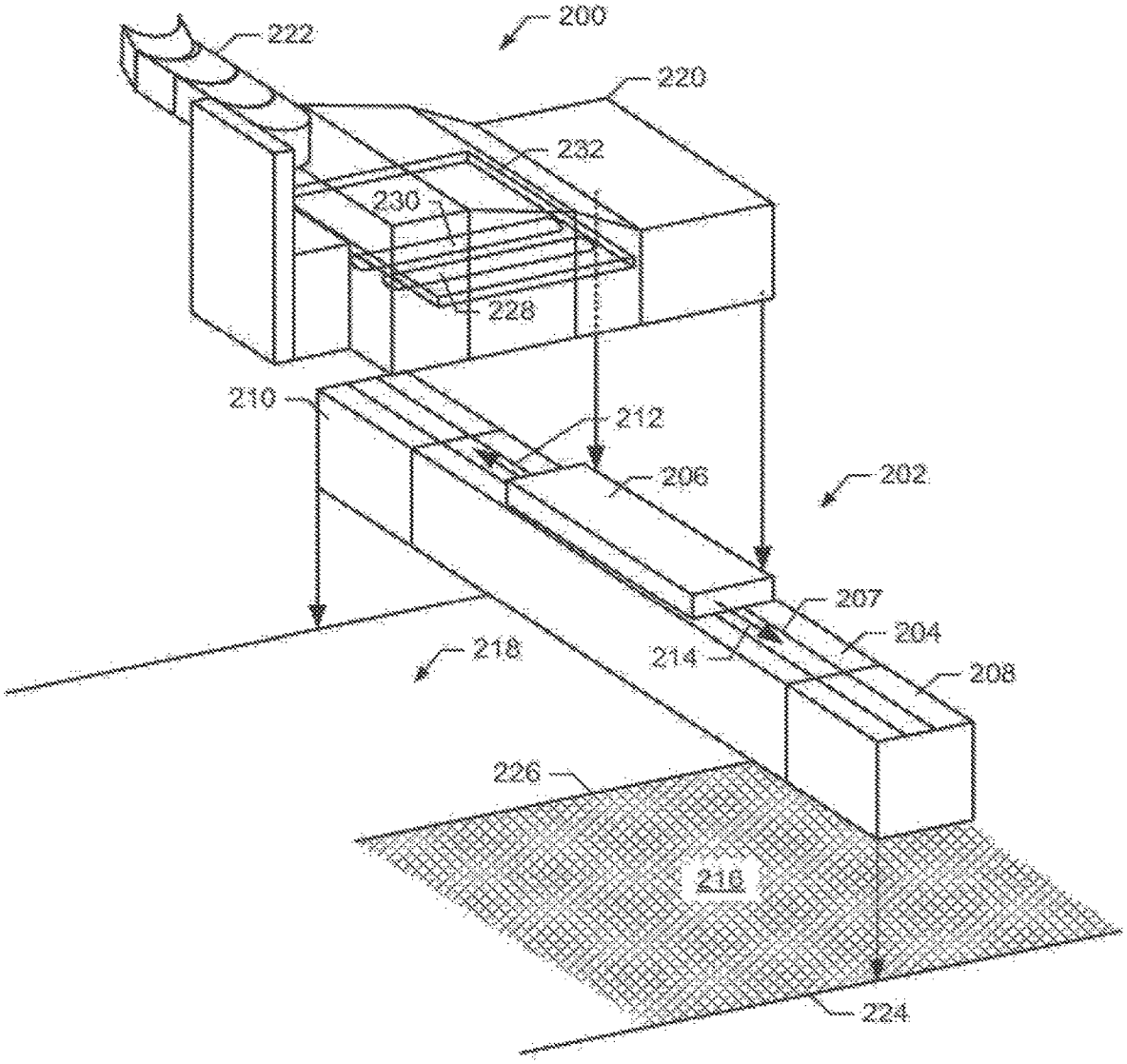
FIG. 2 is a perspective view of an example curing unit and an example carriage that may be used to implement the example apparatus of FIG. 1.

FIG. 2 is a perspective view of an example curing unit 200 and an example carriage 202 that may be used to implement the example apparatus 100 of FIG. 1. In the example illustrated in FIG. 2, the carriage 202 includes a rail 204 located below the curing unit 200. A trolley 206 is coupled to the top of the example rail 204, and can slide along the length of the rail 204 via a track 207. A more detailed illustration of the example carriage 202, including the rail 204, the trolley 206, and the track 207 is provided in FIG. 3 and described below.

The example carriage 202 of FIG. 2 includes rail heads 208, 210 attached to either side of the example rail 204. In some examples, one or both of the rail heads 208, 210 include a driving motor to cause the trolley 206 to move along the track 207 of the rail 204. The possible directions of movement of the trolley 206 and, thus, the curing unit 200 are illustrated in FIG. 2 by directional arrows 212, 214. The example curing unit 200 of FIG. 2 is mounted to the example trolley 206. As a result, the curing unit 200 is moved over a print substrate 216 located in a substrate travel path 218 when the trolley 206 moves along the rail 204 and the substrate 216 is located in the path 218.

The example curing unit 200 of FIG. 2 includes a housing 220 that is mounted to the trolley 206. The housing 220 supports radiation lamps 228, 230 and/or a convection unit 232 for curing ink on the print substrate 216. The example curing unit 200 of FIG. 2 further includes a flexible wire housing 222 to support wires and/or cables providing power and/or signaling to the curing unit 200. As the example curing unit 200 is scanned over the print substrate 216, the wire housing 222 flexes to support the cables to the curing unit 200.

In operation, the trolley 206 moves the curing unit 200 in the first direction 212 from a first edge 224 of the print substrate 216 to a second edge 226 of the print substrate 216 while the curing unit 200 cures ink on an area of the print substrate 216 adjacent the curing unit 200. Subsequently, the example trolley 206 moves the curing unit 200 in the second direction 214 from the second edge 226 to the first edge 212 while the curing unit 200 cures the ink in the same or a different area of the print substrate 216. The trolley 206 alternates moving the curing unit 200 in the first and second directions for times and/or at speeds based on the width of the print substrate 216. The trolley 206 of FIG. 2 ceases movement at the edges 224, 226 such that the curing unit 200 does not move beyond the print substrate 216.

Figure 3B:
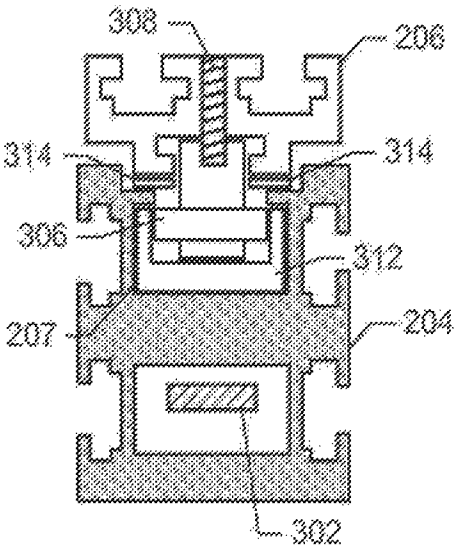
FIG. 3B is a cross-sectional view of the example carriage of FIG. 3A.
Figure 3A:
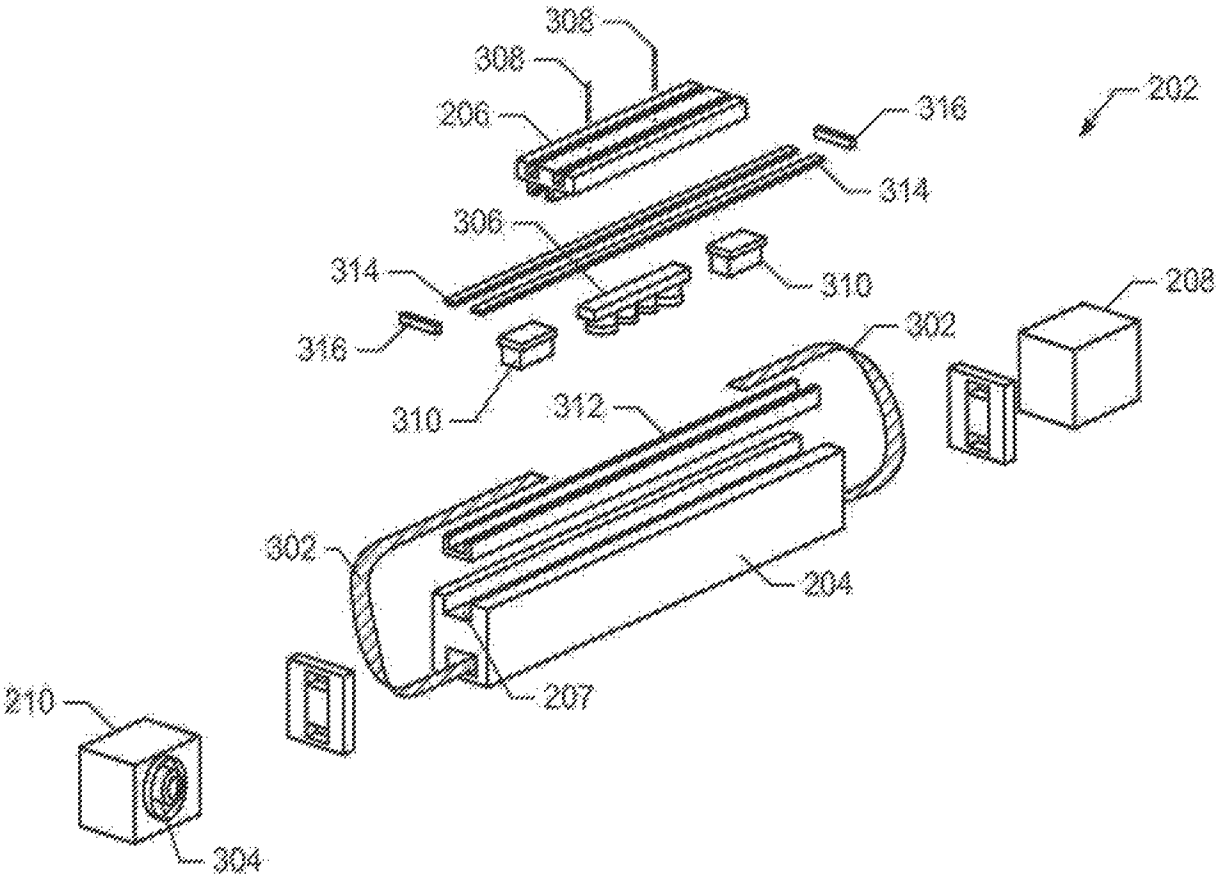
FIG. 3A is an exploded view of an example carriage that may be used to implement the example apparatus of FIG. 1.

FIG. 3A is an exploded view of the example carriage 202 of FIG. 2. The example carriage 202 of FIG. 3A includes the example rail 204. The example rail 204 is dimensioned to extend over the substrate travel path 218 of FIG. 2. The rail 204 is supported at its ends by the rail heads 208, 210. In some examples, the rail heads 208, 210 couple the rail 204 to supporting structure in a printer to position the rail 204 behind a print head relative to a travel direction of a print substrate (i.e., printed portions of the substrate pass the rail 204 to facilitate curing).

The example carriage 202 of FIG. 2 further includes a belt 302 to selectively move the trolley 206. The trolley 206 is mechanically coupled (directly or indirectly) to a curing unit (e.g., the curing unit 200 of FIG. 2) to physically support and move the curing unit 200 over at least a portion of the width (W) of a substrate travel path 106. In the illustrated example of FIG. 3, the belt 302 is rotated around the length of the rail 204 via a belt motor 304 located in the rail head 210. The example belt 302 is provided with teeth along at least one side to mesh with teeth on a gear driven by the motor 304 to allow the belt motor 304 to rotate the belt 302. The example belt motor 304 may be implemented using, for example, a bi-directional electric motor to rotate the belt in either direction along the rail to move the trolley 206 in the corresponding direction. The example belt motor 304 of FIG. 3 may control the scanning direction and/or the scanning speed of the curing unit 200 by adjusting the direction and speed of rotation of the example belt 302. In some examples, the belt motor 304 is controlled via signals from a controller (e.g., the controller 110 of FIG. 1). In some examples, the belt motor 304 is implemented using two uni-directional motors; one located in each of the rail heads 208, 210.

In addition to the belt 302 and the trolley 206, the example carriage 202 includes a roller slider 306 to provide a low-friction interface between the trolley 206 and the rail 204. As mentioned above, the example rail 204 includes a track 207, along which the trolley 206 moves between the rail heads 208, 210. The example roller slider 306 is coupled (e.g., fastened) to the trolley 206 and the track 207 via fastener(s) 308 to thereby couple the trolley 206 and the track 207. The example carriage 202 of FIG. 3A further includes belt tensioner(s) 310 to provide proper tension to the belt 302, a guide rail 312 to provide a surface between the roller slider 306 and the rail 204, seals 314 to trap the roller slider 306 within the track 207, and/or belt wipers 316 to remove potentially harmful particles from the belt 302 during operation. The example guide rail 312 and/or the example seals 314 reduce or even prevent metal-on-metal friction which, over time, could cause wear on the trolley 206 and/or the rail 204 in the absence of an intermediate interface.

In the example of FIG. 3A, the belt tensioners 310 are fastened to the roller slider 306. The example belt 302 is fastened to the example belt tensioners 310 at either end of the belt 302. Accordingly, as the motor 304 moves the belt 302, the belt tensioners 310 and the roller slider 306 move within the guide rail 312, thereby moving the trolley 206 in the corresponding direction.

FIG. 3B is a cross-section view of the example carriage 202 of FIG. 3A. In particular, the view illustrated in FIG. 3B includes the example rail 204, the example belt 302, the example trolley 206, the example track 207, the example roller slider 306, the example guide rail 312, and the example seals 314. As illustrated in FIG. 3B, the example trolley 206 is placed within the guide rail 312, which is positioned in the track 207. The example roller slider 306 is coupled to the belt 302 via the tensioners 310 as illustrated in FIG. 3A. As the belt 302 is moved in either direction along the rail 204, the roller slider 306 is moved within the guide rail 312 and causes the example trolley 206 to move along the rail 204.

The example trolley 206 is further attached to the example curing unit 200 of FIG. 2 via the fastener 308. Thus, as the belt motor 304 rotates the belt 302, the roller slider 306, and the trolley 206 move with the belt 302 within the guide rail 312 and move the attached curing unit 102 in the corresponding direction.

The example carriage 202 may have different lengths based on the width of the printer. For example, the lengths of the rail 204, the belt 302, the guide rail 312, and/or the seals 314 are based on the width of the substrate travel path 218 of FIG. 2.

Figure 4:
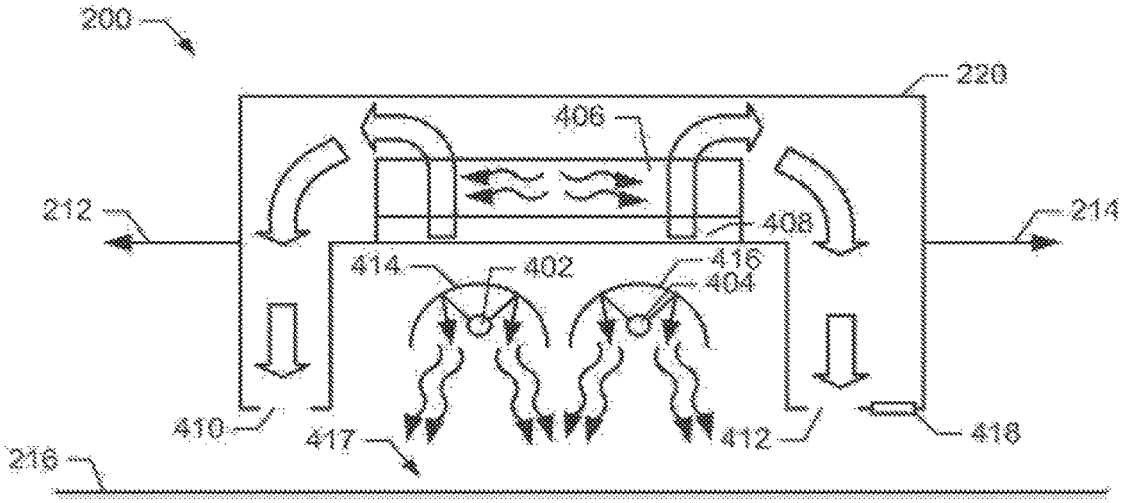
FIG. 4 illustrates an example curing unit that may be used to implement the example apparatus of FIG. 1.

FIG. 4 is a cutaway view of the example curing unit 200 of FIG. 2 to cure ink on a print substrate 216. The example curing unit 200 of FIG. 4 includes curing lamps 402, 404, the example housing 220, a convection heater 406, a fan 408, and air vents 410, 412. The example curing unit 200 of FIG. 4 provides radiation and heated air to cure ink (e.g., latex inks) applied to the example print substrate 216.

The example curing lamps 402, 404 of FIG. 4 may be implemented by infrared heat lamps such as carbon infrared (CIR) lamps, medium-wave infrared (MIR) lamps, near-wave infrared (NIR) lamps, radiant panels, tubular resistors, and/or any other type of radiant-heating elements. The example curing lamps 402, 404 of the illustrated example are partially surrounded by reflectors 414, 416 to reflect radiated heat from the curing lamps 402, 404 to the print substrate 216 in a radiation curing area 417. As illustrated in FIG. 4, the curing lamps 402, 404 are oriented lengthwise in the direction of travel of the print substrate 216.

The example housing 220 of FIG. 4 houses the convection heater 406 and the fan 408. The fan 408 is positioned above the curing lamps 402, 404 and causes air to flow into the housing 220. In particular, the fan 408 draws into the housing 220 the air around the curing lamps 402, 404. This air may have fumes or vapors from the ink that have drifted into the example cavity adjacent the curing lamps 402, 404. In some examples, these vapors can adversely affect curing performance and are undesirable.

The example convection heater 406 of FIG. 4 heats the air entering via the fan 408. The air then flows out of the housing 220 via the air vents 410, 412 toward the print substrate 216. The flow of the air is a result of air pressure created by the fan 408. The example convection heater 406, the example fan 408, and the heated air exiting the air vents 410, 412 removes vapors (e.g., vapors from latex inks) from the region around curing lamps 402, 404 and assists the example curing lamps 402, 404 in managing the temperature of the print substrate 216.

To assist in managing the temperature, the example curing unit 200 further includes a temperature sensor 418. In some examples, the temperature sensor 418 provides the temperature (e.g., a signal indicative of the temperature) to a controller (e.g., the controller 110 of FIG. 1). In the example of FIG. 4, the temperature sensor 418 determines the temperature of the marking agent on the substrate 216 and/or the air adjacent the marking agent that may be used as an approximate temperature of the marking agent. In some examples, the controller controls the curing lamp(s) 402, 404 and/or the convection heater 406 (e.g., a temperature of the convection heater 406) based on the temperature. For example, if the controller determines (via the temperature sensor 418) that the temperature of the marking agent is too high (e.g., greater than a threshold temperature), the controller may lower the temperature of the convection heater 406, lower the power provided to the curing lamps 402, 404, or both.

Figure 5:
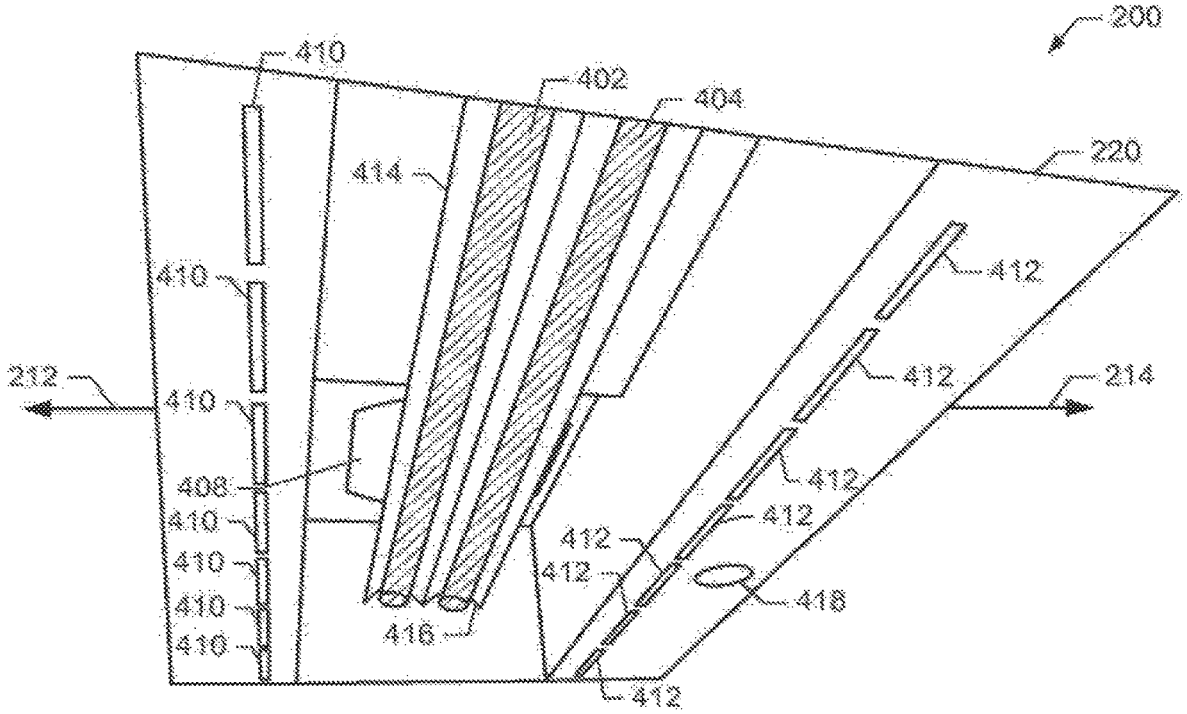
FIG. 5 is a perspective view of the example curing unit of FIG. 4.

FIG. 5 is a perspective view of an example implementation of the example curing unit 200 of FIG. 4. In the example of FIG. 5, the air vents 410, 412 are implemented using a series of slots along the length of the curing unit 200. The slots provide openings for an air flow to exit the example housing 220 toward the print substrate 216. The air flow is generated by the example fan 408, which is partially obscured by the example reflectors 414, 416. As described above, the fan 408 draws air into the housing 220, where it is heated by the convection heater 406 of FIG. 4 and then output via the air vents 410, 412 (e.g., the slots). While the example air vents 410, 412 of FIG. 5 are illustrated as a series of slots, the air vents 410, 412 may additionally or alternatively be implemented using other configurations.

In the examples of FIGS. 4 and 5, the curing lamps 402, 404 are set farther away from the print substrate 216 than the air vents 410, 412. Such configuration concentrates the radiated energy (e.g., heat) from the example curing lamps 402, 404 to an area of the print substrate 216 that is narrower than the width of the print substrate 216.

During operation, the example curing unit 200 of FIGS. 4 and 5 is reciprocated (e.g., moved back and forth in alternating directions) in the scanning directions 212, 214 to cure ink on the print substrate 216. For example, the carriage 202 of FIGS. 2, 3A, and 3B may be used to alternate moving the curing unit 200 in the first direction 212 and the second direction 214. While the curing unit 200 is reciprocated, the example curing lamps 402, 404 radiate heat to cure ink in an area (e.g., a radiation curing area) of the print substrate 216 adjacent the curing unit 200. In the example of FIGS. 4 and 5, the width of the area cured by the example curing lamps 402, 404 at any given time is less than the width of the print substrate 216.

The example curing unit 200 of FIG. 2 stops movement in either of the scanning directions 212, 214 when the area cured by the curing lamps 402, 404 reaches the corresponding edge of the print substrate 216. In some examples, the curing unit 200 is moved at a slower speed when the area cured by the curing lamps 402, 404 approaches and/or enters an edge region of the print substrate 216. Due to the longer time between applications of radiated heat at the edge regions of the print substrate 216 than in the central region, slowing the curing unit in the edge regions enhances the curing performance in those regions.

Figure 6:
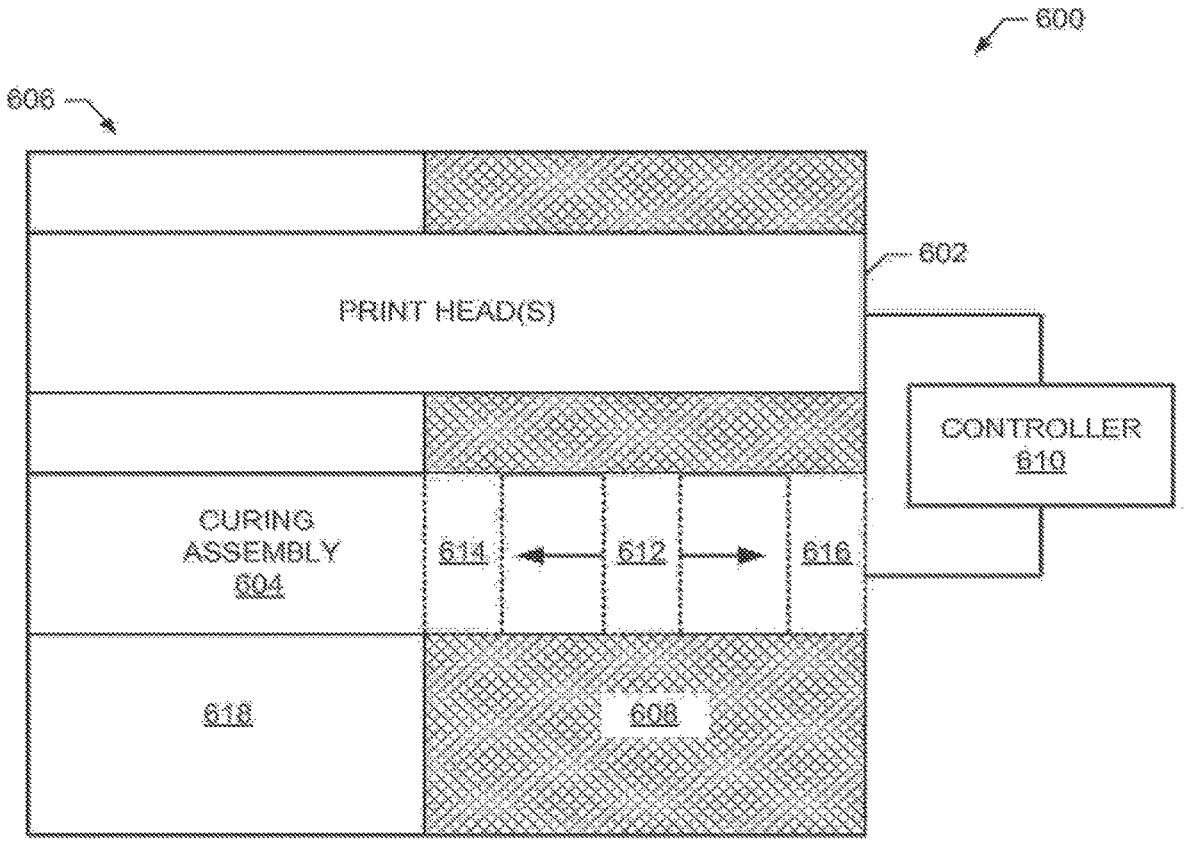
FIG. 6 is a block diagram of an example image forming apparatus including print heads and a curing unit.

FIG. 6 is a block diagram of an example image forming apparatus 600 including print head(s) 602 and a curing assembly 604. The example image forming apparatus 600 of FIG. 6 is a large-format printer that is fitted with the example apparatus 100 of FIG. 1, the example curing unit 200 of FIGS. 2, 4, and 5, and/or the example carriage 202 of FIGS. 2, 3A, and 3B. However, the example image forming apparatus 600 may additionally or alternatively represent other types of image forming apparatus having a curing assembly constructed in accordance with the teachings of this disclosure.

The example print head(s) 602 and the curing assembly 604 extend across the width of a substrate travel path 606. As illustrated in FIG. 6, a print substrate 608 is positioned in the substrate travel path 606, where the width of the print substrate 608 is less than the width of the substrate travel path 606. In some other examples, the print substrate 608 is equal to the width of the substrate travel path 606.

As illustrated in FIG. 6, the example curing assembly 604 spans the width of the substrate travel path 606. In some examples, a first subassembly (e.g., a carriage) of the curing assembly 604 is as wide as the substrate travel path 606 (e.g., the carriage 108 of FIG. 1, the carriage 202 of FIGS. 2, 3A, and 3B) while a second subassembly (e.g., a curing lamp) of the curing assembly 604 has a width less than that of the print substrate 608 (e.g., the curing unit 102 of FIG. 1, the curing unit 200 of FIG. 2, etc.).

The example image forming apparatus 600 of FIG. 6 further includes a controller 610. The example controller 610 of FIG. 6 controls the print head(s) 602 to print a desired pattern of ink on the print substrate 608 and controls the curing assembly 604 to cure the ink on the print substrate 608. For example, the controller 610 receives a print task including a pattern or design to be printed with ink on the print substrate 608 and then cured to form a hard image. In the illustrated example, the controller 610 controls the print head(s) 602 and the curing assembly 604 to perform the printing and the curing tasks simultaneously on different portions of the print substrate 608 during a print operation. To control the curing assembly 604, the example controller 610 of FIG. 6 determines the width of the print substrate 608 and causes the curing assembly 604 to cure the print substrate 608 without extending the curing assembly 604 and/or the heat-applying portion of the curing assembly 604 laterally beyond the edges of the print substrate 608.

In operation, the example print head(s) 602 of FIG. 6 apply a marking agent (e.g., ink) to the print substrate 608 traveling in the substrate travel path 606. The example curing assembly 604 of FIG. 6 applies heat to an area 612 along the substrate travel path 606. The curing assembly 604 applies heat to the width of the print substrate 608 by moving a curing unit (e.g., the curing unit 200) including curing lamps (e.g., the curing lamps 402, 404) and, thus, the area 612 over the print substrate 608. In particular, the curing assembly 604 moves from a first position 614 at the leftmost edge of the print substrate 608 to a second position 616 at the rightmost edge of the print substrate, and then moves from the second position 616 to the first position 614. The speed with which the curing assembly 604 moves the area 612 is based on the width of the print substrate 608, the power output by the example curing assembly 604 for curing, and/or the printing throughput. The example curing assembly 604 does not move the heating area 612 into the portion 618 of the substrate travel path 606 that does not include the print substrate 608 (e.g., ceases moving at an outer edge of the print substrate 608 that defines the width of the print substrate 608), thereby conserving energy by avoiding heating areas beyond the print substrate 608.

Figure 7A:
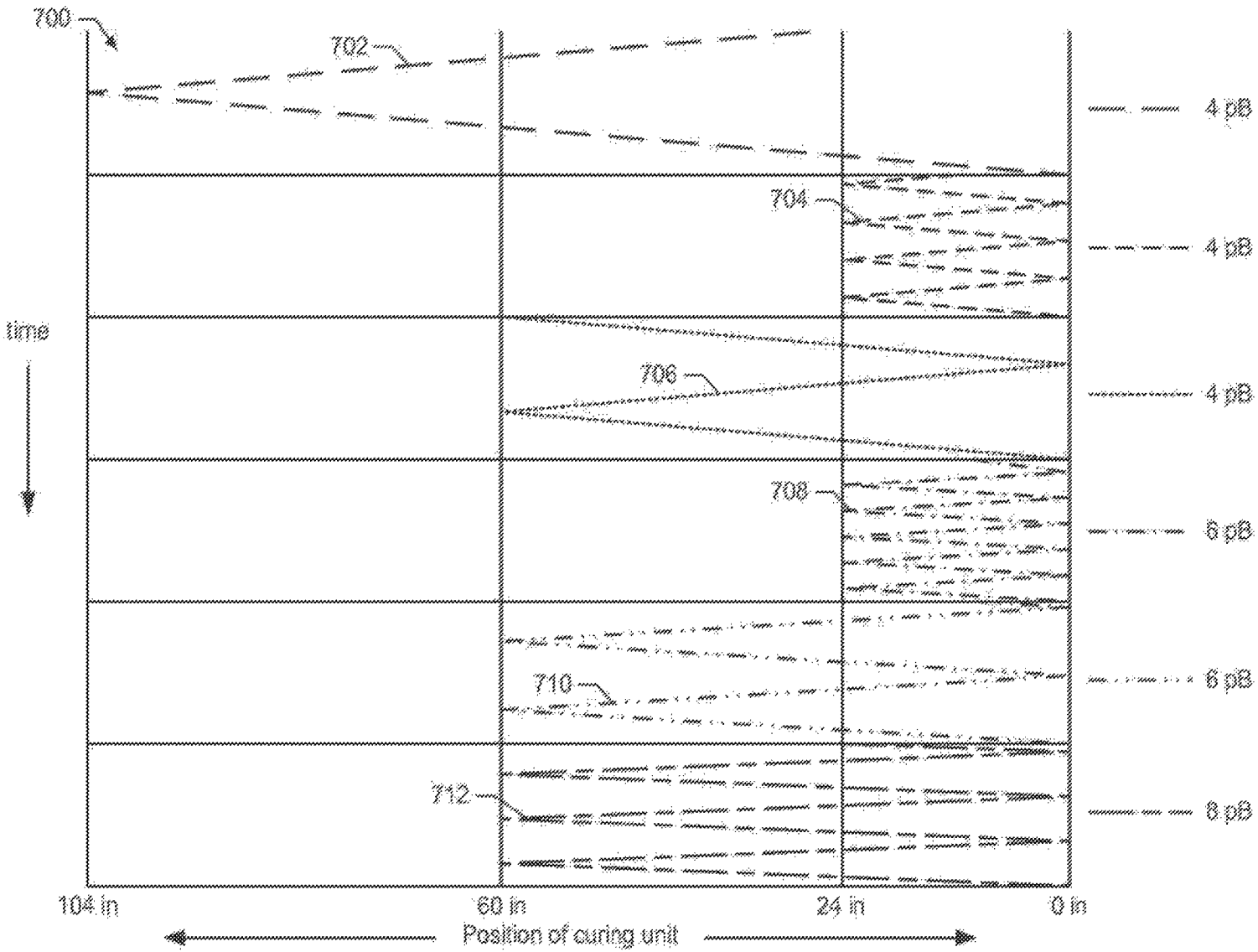
FIG. 7A illustrates example scanning paths of the curing unit of FIG. 1.

FIG. 7A is a graph illustrating example travel paths 702, 704, 706, 708, 710, 712 of the curing unit 102 of FIG. 1. The example travel paths 702, 704, 706, 708, 710, 712 are representative of the position of the curing unit 102 with respect to the substrate travel path 106 of FIG. 1. The example travel paths 702, 704, 706, 708, 710, 712 correspond to numbers of bidirectional printing passes of a print head (e.g., 4 pB refers to 4 passes of bidirectional printing, 6 pB refers to 6 passes, etc.). A lower number of passes results in a higher printing throughput. As illustrated in the example of FIG. 7A, the leftmost side of the example graph 700 is the leftmost position of the curing unit 102 adjacent the substrate travel path 106 and the rightmost side of the example graph 700 is the rightmost position of the curing unit 102 adjacent the substrate travel path 106.

As illustrated in FIG. 7A, the position of the curing unit 102 changes in time. Specifically, the example curing unit 102 moves between the left and right edges of the print substrate 104. The number of passes across the print substrate 104 depends on the width of the print substrate 104, and/or the power applied by the curing unit 102 to cure the ink. For example, the travel path 702 includes less than two passes over a first example print substrate having a width of 104 inches, while the travel path 704 includes more than 7 full passes over a second example print substrate having a width of 24 inches. In contrast, the example travel path 706 includes about 3 passes over a third print substrate having a width of 60 inches, while the example travel path 710 includes about 4 passes over a fourth print substrate also having a width of 60 inches due to a higher power output by the curing lamps during the example travel path 710.

Figure 7B:
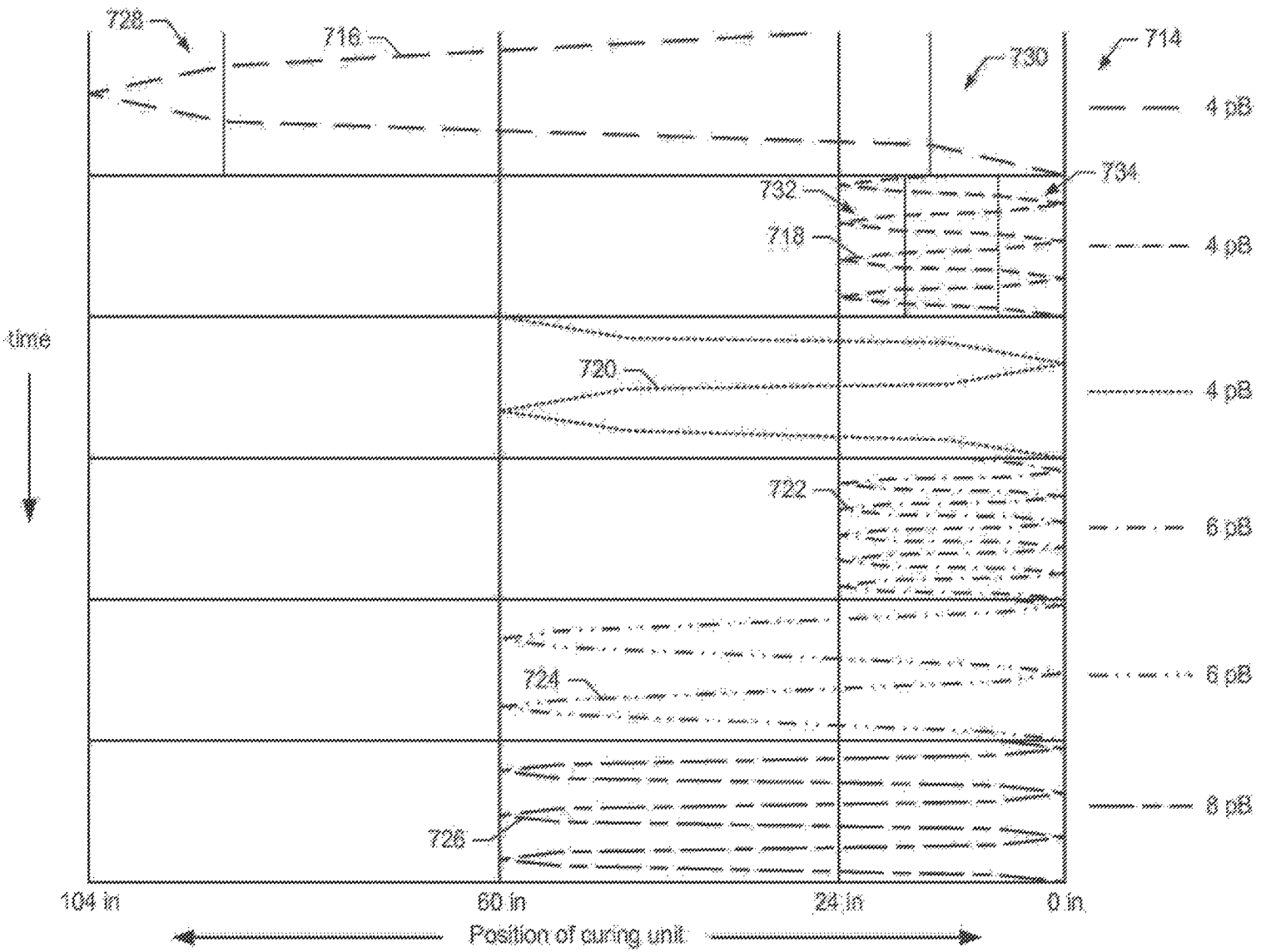
FIG. 7B illustrates alternative example scanning paths of the curing unit of FIG. 1.

FIG. 7B is a graph 714 illustrating additional example travel paths 716, 718, 720, 722, 724, 726 of the curing unit 102 of FIG. 1. Like the example travel paths 702-712 of FIG. 7A, the example travel paths 716-726 of FIG. 7B are based on the width of the print substrate 104 and/or the power applied by the curing unit 102. However, unlike to the example travel paths 702-712 of FIG. 7A, the example travel paths 716-726 reflect a slowing of the speed of the curing unit 102 near the edges of the substrate. For example, the travel path 716 of FIG. 7B slows to use more time within areas 728, 730 near the edges of an example print substrate 104 having a width equal to the width of the substrate travel path. Similarly, the example travel path 718 slows to use more time within areas 732, 734 near the edges of another example print substrate having a width less than the width of the print substrate.

In some examples, the areas 728-734 are based on a width of the print substrate received or determined by a controller (e.g., the controller 110 of FIG. 1). As the width of the print substrate increases, the curing unit 102 passes over the edge areas 728-734 less often and the controller 110 may therefore increase the size of the edge areas 728-734 in which the curing unit 102 is moved more slowly. Increasing the size of the edge areas 728-734 may help ensure adequate curing within the edge areas 728-734.

Figure 8:
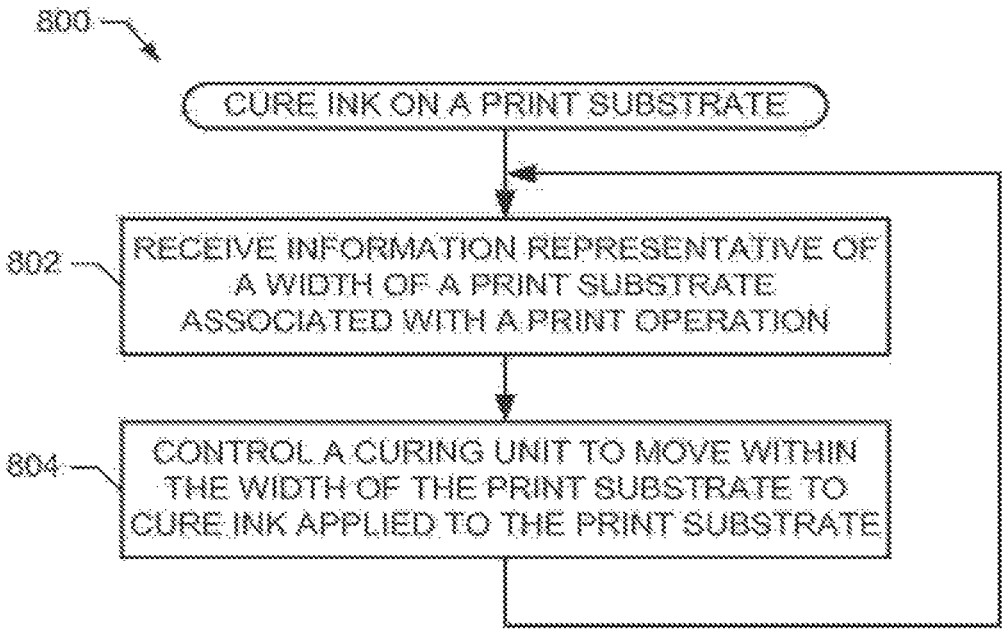
FIG. 8 is a flowchart illustrating example machine readable instructions that may be executed to implement the example apparatus of FIGS. 1-5 and/or the image forming apparatus of FIG. 6.

A flowchart representative of example machine readable instructions 800 for implementing the apparatus 100, 200, 202 of FIGS. 1-5 and/or the example image forming apparatus 600 of FIG. 6 is shown in FIG. 8. In this example, the machine readable instructions 800 comprise a program for execution by a processor such as the processor 902 shown in the example processor platform 900 discussed below in connection with FIG. 9. The program may be embodied in software stored on a computer readable medium such as a CD-ROM, a floppy disk, a hard drive, a digital versatile disk (DVD), or a memory associated with the processor 902, but the entire program and/or parts thereof could alternatively be executed by a device other than the processor 902 and/or embodied in firmware or dedicated hardware. Further, although the example program is described with reference to the flowchart illustrated in FIG. 8, many other methods of implementing the example apparatus 100, 200, 202 and/or the example image forming apparatus 600 may alternatively be used. For example, the order of execution of the blocks may be changed, and/or some of the blocks described may be changed, eliminated, or combined.

The example process of FIG. 8 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example process of FIG. 8 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

The example instructions 800 may be executed to implement the example apparatus 100, 200, 202 of FIGS. 1-5 and/or the example image forming apparatus 600 of FIG. 6. Execution of the example instructions 800 of FIG. 8 reduces the energy used to cure ink on a print substrate relative to known curing apparatus and methods while maintaining curing performance and the quality of the formed image. For purposes of illustration and not by way of limitation, the example instructions 800 will be discussed with reference to the example apparatus 100 of FIG. 1.

The example instructions 800 begin by receiving information representative of a width of a print substrate (e.g., the print substrate 104 of FIG. 1) associated with a print operation (block 802). For example, the controller 110 may receive an indication of the width of the print substrate 104 based on data corresponding to the print operation. Example data includes the width of the print substrate 104 as specified in the printing task (e.g., a field in a print job received from a computer or other input), specified in a paper selection field (e.g., an instruction to a print substrate tray to pick a sheet), and/or determined from a measurement of a print substrate width (e.g., via a sensor).

The example controller 110 moves a curing unit (e.g., the curing unit 102) within the width of the print substrate 104 to cure ink applied to the print substrate 104 (block 804). For example, the controller 110 moves the curing unit 102 by controlling the carriage 108 to move the curing unit 102 laterally across the width of the print substrate 104. The controller 110 controls the carriage 108 to avoid positioning the curing unit 102 beyond the width of the print substrate 104. The example instructions 800 may then end or iterate to continue curing ink on the print substrate 104.

Figure 9:
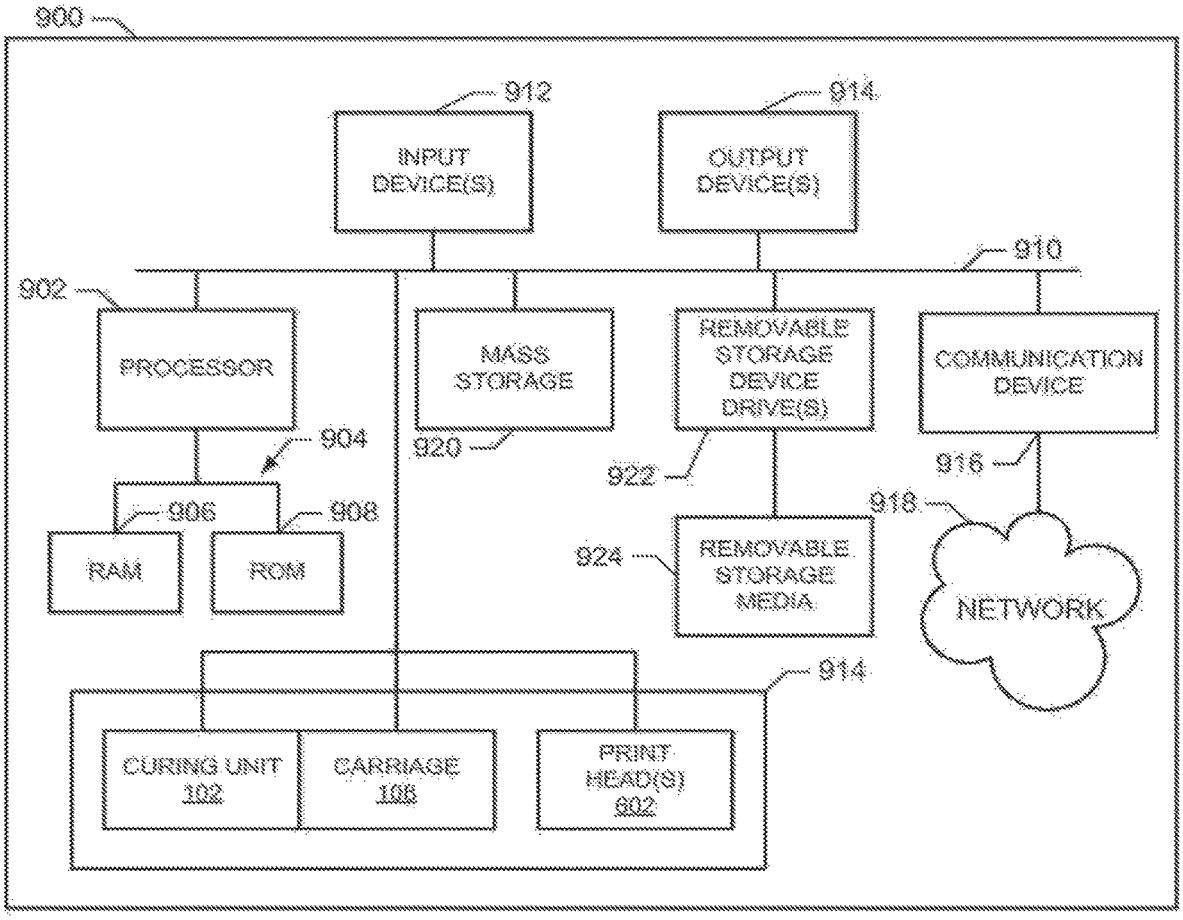
FIG. 9 is a is a block diagram of an example machine capable of executing the instructions of FIG. 8 to implement the apparatus of FIGS. 1-5 and/or the image forming apparatus of FIG. 6.

FIG. 9 is a block diagram of an example processor platform 900 capable of executing the instructions of FIG. 8 to implement the apparatus 100, 200, 202 of FIGS. 1-5 and/or the image forming apparatus 600 of FIG. 6. The processor platform can be, for example, a controller for a printer or other image forming apparatus and/or any other type of processing or controller platform to execute printing commands. The control platform of the instant example includes a processor 902. For example, the processor 902 can be implemented by one or more microprocessors, embedded microcontrollers, system on a chip (SoC), and/or any other type of processing, arithmetic, and/or logical unit.

The processor 902 is in communication with a main memory 904 including a volatile memory 906 and a non-volatile memory 908. The volatile memory 906 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 908 may be implemented by read-only memory (ROM), flash memory, and/or any other desired type of memory device. Access to the main memory 904 is typically controlled by a memory controller.

The controller 900 also includes an interface circuit, such as a bus 910. The bus 910 may be implemented by any type of past, present, and/or future interface standard, such as an Ethernet interface, a universal serial bus (USB), and/or a PCI express interface.

Input device(s) 912 are connected to the bus 910. The input device(s) 912 permit a user to enter data and commands into the processor 902. The input device(s) 912 can be implemented by, for example, a keyboard, a programmable keypad, a mouse, a touchscreen, a track-pad, a trackball, isopoint, and/or a voice recognition system.

Output device(s) 914 are also connected to the bus 910. The example output device(s) 914 of FIG. 9 are implemented, for example, by display devices (e.g., a liquid crystal display, a cathode ray tube display (CRT), and/or speakers) and printer devices (e.g., print head(s), substrate path control, curing assemblies, curing units, carriages, etc.). In particular, the processor 902 of the illustrated example provides commands to the example curing unit 102 via the bus 910. The processor 902 of the illustrated example provides commands to the curing unit 102 of FIG. 1 in order to control an amount of radiated heat generated by the curing unit 102 (e.g., the temperature of the curing lamps 402, 404 of FIG. 4). The example processor 902 also provides signals and/or instructions to the carriage 108 of FIG. 1 to control the movement direction and/or speed of the curing unit 102. For example, the processor 902 may control the carriage 108 by providing a signal to the example belt motor 304 of FIG. 3. The example processor 902 of FIG. 9 further provides instructions to the print head(s) 602 of FIG. 6 via the bus 910 in order to generate ink droplets for forming an image on a print substrate (e.g., the print substrate 104 of FIG. 1, the print substrate 216 of FIGS. 2 and 4, and/or the print substrate 608 of FIG. 6).

In some examples the bus 910 includes a graphics driver card to output graphics on a display device. The example bus 910 also includes a communication device 916 such as a wired or wireless network interface card to facilitate exchange of data (e.g., images to be formed on a substrate) with external computers via a network 918.

The example controller 900 of FIG. 9 further includes mass storage device(s) 920 and/or removable storage drive(s) 922 for storing software and/or data. Machine readable removable storage media 924 may be inserted into the removable storage drive 922 to allow the removable storage drive 922 to provide the instructions contained on the media 924 to, for example, the processor 902. Examples of such mass storage devices 920 and/or computer readable media include floppy disks, hard drive disks, compact discs (CDs), digital versatile discs (DVDs), memory cards, Universal Serial Bus (USB) storage drives, and/or any other articles of manufacture and/or machine readable media capable of storing machine readable instructions such as the coded instructions 800 of FIG. 8. Accordingly, the coded instructions 800 of FIG. 8 may be stored in the machine readable removable storage media 924, the mass storage device 920, in the volatile memory 906, and/or in the non-volatile memory 908.

From the foregoing, it will be appreciated that the above-disclosed apparatus, methods, and/or articles of manufacture may be used to cure ink applied to a print substrate to form a hard image. In contrast to known curing apparatus, methods, and articles of manufacture disclosed above reciprocate a curing unit across a width of a print substrate without moving beyond the width of the print substrate. As a result, example apparatus, methods, and articles of manufacture disclosed herein use less energy to cure ink on the print substrate than known curing apparatus without sacrificing image quality, curing performance, or printing speed. Additionally, example apparatus, methods, and articles of manufacture disclosed allow for the width of the printer implementing the apparatus, methods, and/or articles of manufacture to be reduced compared to known curing apparatus.

Although certain example apparatus, methods, and articles of manufacture have been disclosed herein, the scope of coverage of this patent is not limited thereto. On the contrary, this patent covers all apparatus, methods, and articles of manufacture fairly falling within the scope of the claims of this patent.

What is claimed is:

1. A method of curing a print substrate while printing on the substrate, the method comprising:

operating a curing unit that comprises a lamp partially surrounded by a reflector to direct radiation from a radiation source of the lamp toward the substrate;

providing radiation from the lamp to a radiation curing area to cure a marking agent on the substrate; and moving the curing unit at a first rate at a central region of a substrate and moving the curing unit at a second rate at an edge region of the substrate, the second rate being slower than the first rate, wherein operating the curing unit further comprises reciprocating the curing unit within a substrate width of the print substrate.

2. The method of claim 1, further comprising:

detecting a temperature of the marking agent; and controlling the lamp based on a detected temperature of the marking agent.

3. The method of claim 1, wherein the curing unit further comprises a convection heater, the method further comprising applying heated air to cure the marking agent on the substrate with the convection heater.

4. The method of claim 3, further comprising:

detecting a temperature of the marking agent; and controlling the convection heater based on a detected temperature of the marking agent.

5. The method of claim 1, further comprising applying a marking agent to a first area of the substrate to print a desired image on the substrate.

6. The method of claim 5, further comprising applying the marking agent to the first area of the substrate while simultaneously curing a second area of the substrate with the curing unit.

7. An image forming method comprising:

with a print head, applying a marking agent to a print substrate having a substrate width and traveling in a substrate travel path; and reciprocating a curing unit that comprises a lamp partially surrounded by a reflector to direct radiation from a radiation source of the lamp to cure the marking agent on the substrate, the curing unit being reciprocated back and forth over the width of the substrate;

the method further comprising applying the marking agent to a first area of the print substrate while, at a same time, curing a second area of the print substrate with the curing unit, wherein reciprocating the curing unit comprises reciprocating a carriage of the curing unit across the width of the print substrate, and moving the curing unit at a first rate within a central region of the print substrate and moving the curing unit at a second rate within at least one edge region of the print substrate, the second rate being slower than the first rate.

8. The method of claim 7, further comprising:

detecting a temperature of the marking agent; and controlling the lamp based on a detected temperature of the marking agent.

9. The method of claim 7, wherein the curing unit comprises a convection heater, the method further comprising, with a fan of the curing unit, applying heated air from the convection heater to cure the marking agent on the substrate.

10. The method of claim 9, further comprising:

detecting a temperature of the marking agent; and controlling the convection heater based on a detected temperature of the marking agent.

11. The method of claim 7, wherein the radiation source is an infrared radiation source.

12. An image forming apparatus comprising:

a print head to selectively apply a marking agent to a print substrate that has a substrate width in a substrate travel path;

a curing unit mounted on a carriage to reciprocate back and forth over the width of the substrate; and the curing unit comprising a lamp mounted on the carriage to emit radiation to cure the marking agent on the substrate;

wherein the print head and curing unit are to, respectively, apply the marking agent to a first area of the print substrate while, at a same time, cure a second area of the print substrate where marking agent is already applied, and wherein the carriage is to move the curing unit at a first rate within a central region of the print substrate and move the curing unit at a second rate within at least one edge region of the print substrate, the second rate being slower than the first rate.

13. The image forming apparatus of claim 12, wherein the lamp further comprising a radiation source that is partially surrounded by a reflector to direct radiation from the radiation source of the lamp to the print substrate.

14. The image forming apparatus of claim 12, further comprising:

a temperature sensor arranged for detecting a temperature of the marking agent; and a controller to control the lamp based on a detected temperature of the marking agent.

15. The image forming apparatus of claim 12, wherein the curing unit further comprises a convection heater with a fan on the carriage to apply heated air to cure the marking agent on the substrate.

16. The image forming apparatus of claim 15, further comprising:

a temperature sensor arranged for detecting a temperature of the marking agent; and a controller to control the convection heater based on a detected temperature of the marking agent.

17. The image forming apparatus of claim 12, wherein the radiation source is an infrared radiation source.

* * * * *